US009084702B2

(12) United States Patent
Bertsch

(10) Patent No.: US 9,084,702 B2
(45) Date of Patent: Jul. 21, 2015

(54) MC2 FOLDING RESCUE STRETCHER

(71) Applicant: Michael Charles Bertsch, San Francisco, CA (US)

(72) Inventor: Michael Charles Bertsch, San Francisco, CA (US)

( * ) Notice: Subject to any disclaimer, the term of this patent is extended or adjusted under 35 U.S.C. 154(b) by 55 days.

(21) Appl. No.: 13/865,265

(22) Filed: Apr. 18, 2013

(65) Prior Publication Data

US 2014/0082844 A1 Mar. 27, 2014

Related U.S. Application Data

(63) Continuation-in-part of application No. 13/423,093, filed on Mar. 16, 2012, now abandoned.

(51) Int. Cl.

| | |
|---|---|
| ***A61G 1/013*** | (2006.01) |
| ***A61G 1/00*** | (2006.01) |
| ***F41H 5/08*** | (2006.01) |
| ***F41H 5/02*** | (2006.01) |

(52) U.S. Cl.

CPC *A61G 1/013* (2013.01); *F41H 5/02* (2013.01); *F41H 5/08* (2013.01); *A61G 1/00* (2013.01)

(58) Field of Classification Search

CPC ..... A61G 1/00; A61G 1/007; A61G 1/01; A61G 1/013; A61G 1/04; A61G 1/044; A61G 1/048

USPC ..... 5/627, 628, 625, 110–112, 114

See application file for complete search history.

(56) References Cited

U.S. PATENT DOCUMENTS

| | | | | |
|---|---|---|---|---|
| 1,072,052 | A * | 9/1913 | Stoehrc | 5/626 |
| 1,266,723 | A * | 5/1918 | Shapac | 5/627 |
| 2,328,047 | A * | 8/1943 | Anderson et al. | 5/626 |
| 2,650,373 | A | 9/1953 | Zeller et al. | |
| 3,287,895 | A | 11/1966 | Hire | |
| 3,373,454 | A * | 3/1968 | Curtis | 5/627 |
| 3,417,412 | A | 12/1968 | Andrews | |
| 3,886,606 | A | 6/1975 | Bradford | |
| 3,947,686 | A * | 3/1976 | Cooper et al. | 378/209 |
| 4,216,556 | A * | 8/1980 | Haeussinger | 5/627 |
| 4,466,145 | A * | 8/1984 | Jones et al. | 5/625 |
| 4,670,921 | A * | 6/1987 | Avni et al. | 5/627 |
| 5,023,968 | A * | 6/1991 | Diehl et al. | 5/81.1 R |
| 5,839,137 | A | 11/1998 | Butler et al. | |
| 7,022,094 | B2 * | 4/2006 | Buckman et al. | 602/23 |
| 7,507,216 | B2 * | 3/2009 | Buckman et al. | 602/32 |
| 7,935,069 | B2 * | 5/2011 | Buckman et al. | 602/39 |
| 8,127,381 | B2 | 3/2012 | Westmoreland, II et al. | |
| 8,211,046 | B2 * | 7/2012 | Buckman et al. | 602/39 |
| 8,365,326 | B2 * | 2/2013 | Kenalty et al. | 5/628 |
| 8,615,829 | B2 * | 12/2013 | Kenalty et al. | 5/628 |
| 8,881,327 | B2 * | 11/2014 | Kenalty et al. | 5/628 |
| 8,898,839 | B2 * | 12/2014 | Kenalty et al. | 5/628 |
| 8,938,828 | B2 * | 1/2015 | Kenalty et al. | 5/627 |
| 2004/0167450 | A1 * | 8/2004 | Buckman et al. | 602/23 |
| 2006/0184083 | A1 * | 8/2006 | Buckman et al. | 602/32 |
| 2009/0187127 | A1 * | 7/2009 | Buckman et al. | 602/13 |
| 2010/0138999 | A1 | 6/2010 | Westmoreland, II et al. | |
| 2011/0099717 | A1 | 5/2011 | Windauer | |

(Continued)

*Primary Examiner* — Robert G Santos

(74) *Attorney, Agent, or Firm* — Mitchell A. Rossman; Terra Nova Patent Law, PLLC

(57) ABSTRACT

The present invention provides a foldable rescue stretcher having an open position for transporting a patient and a storing position for storing the foldable rescue stretcher. The foldable rescue stretcher includes a rigid supporting frame having a plurality of sections, a protective barrier, and an inflatable collar. Methods of using the foldable rescue stretcher are also provided.

13 Claims, 9 Drawing Sheets

(56) References Cited

U.S. PATENT DOCUMENTS

| | | | | |
|---|---|---|---|---|
| 2011/0185504 | A1 | 8/2011 | Kenalty et al. | |
| 2011/0213285 | A1* | 9/2011 | Buckman et al. | 602/36 |
| 2012/0151679 | A1* | 6/2012 | Kenalty et al. | 5/628 |
| 2012/0271215 | A1* | 10/2012 | Buckman et al. | 602/39 |
| 2013/0139319 | A1* | 6/2013 | Kenalty et al. | 5/628 |
| 2013/0276227 | A1* | 10/2013 | Kenalty et al. | 5/81.1 R |
| 2013/0276235 | A1* | 10/2013 | Kenalty et al. | 5/627 |
| 2014/0082844 | A1* | 3/2014 | Bertsch | 5/627 |

* cited by examiner

MC2 FOLDING RESCUE STRETCHER

RELATED APPLICATIONS

This is a continuation-in-part application that claims priority to U.S. Non-Provisional patent application Ser. No. 13/423,093 filed Mar. 16, 2012, which is hereby incorporated by reference in its entirety for all purposes.

BACKGROUND OF THE INVENTION

There are situations where an individual becomes ill or injured in the field and it is necessary to move the individual to a treatment site. This is often the case in the battle field, in rescue operations, or in police/fire deployed environments. Other situations include hunters who are injured in a remote area. In any of these cases, it may be required that the injured person be transported great distances in the field so that medical aid can be administered. In some situations, such as battlefield, a delay or failure in providing transport may result in further injury or death. Currently, moving such injured or ill party requires use of a stretcher, which typically must be produced at the site of the injured person. Typically, the stretcher includes a canvas material stretched between two poles and several cross members. To carry a stretcher while performing duties in the field is impractical because it is burdensome and adds extra weight to the bearer. Consequently, people typically do not carry stretchers. When a person goes down, the members of the party drag out or carry the injured party. In some cases, the injured party is left in the field until transport arrives, which significantly increases the risk of complication and death to the injured party.

What is needed is a stretcher that overcomes the deficiencies of prior stretcher type devices.

SUMMARY OF THE INVENTION

The present invention provides a foldable rescue stretcher having an open position for transporting a patient and a storing position for storing the foldable rescue stretcher. The foldable rescue stretcher includes a rigid supporting frame having a plurality of sections, a protective barrier, and an inflatable collar. The foldable rescue stretcher is used to transport a patient in the field with greater ease. The foldable rescue stretcher is lightweight can be transported, folded, and unfolded by one person. The inflatable collar can be easily inflated by mouth, a hand or foot pump, or a pressurized gas cylinder to provide flotation in a marine environment. Once deployed with a patient therein, the foldable rescue stretcher can be hoisted from land or sea by a helicopter or other rescue transport.

The present invention provides a foldable rescue stretcher having an open position for transporting a patient and a storing position for storing the foldable rescue stretcher. The foldable rescue stretcher includes: a rigid supporting frame having a first surface, a second surface, a third surface, a fourth surface, a proximal end, and a distal end, wherein the rigid supporting frame forms an internal cavity extending from the proximal end to the distal end, the rigid supporting frame including: a first section having a first surface, a second surface, a third surface, a fourth surface, a proximal end, and a distal end, the first section including: one or more first restraining belts each independently having a proximal end and a distal end coupled to the second surface of the first section; one or more first handles each independently coupled to the proximal end of the first section; a first protective barrier coupled to the first surface, the third surface, and the fourth surface of the first section; a second section having a first surface, a second surface, a third surface, a fourth surface, a proximal end, and a distal end, the second section including: one or more second restraining belts each independently having a proximal end and a distal end coupled to the second surface of the second section; wherein a second protective barrier covers the first surface, the third surface, and the fourth surface of the second section, wherein the proximal end of the second section is coupled to the distal end of the first section with one or more first folding locking mechanical joints on the first surface of the first section and the first surface of the second section; and a third section having a first surface, a second surface, a third surface, a fourth surface, a proximal end, and a distal end, the third section including: one or more third restraining belts each independently having a proximal end and a distal end coupled to the second surface of the third section; one or more second handles each independently coupled to the distal end of the third section; wherein a third protective barrier covers the first surface, the third surface, and the fourth surface of the third section; wherein the proximal end of the third section is coupled to the distal end of the second section with one or more second folding locking mechanical joints on the second surface of the second section and the second surface of the third section.

In one embodiment, the foldable rescue stretcher further includes an inflatable collar coupled to the third surface, the fourth surface, and the proximal end of the rigid supporting frame.

In one embodiment, the foldable rescue stretcher further includes one or more support legs each independently coupled to the first surface of the first section, the first surface of the second section, and the first surface of the third section.

In one embodiment, the foldable rescue stretcher further includes one or more latches each independently coupled to the first surface of the first section and the second surface of the third section.

In one embodiment, the foldable rescue stretcher further includes one or more latch fasteners each independently coupled to the first surface of the second section and the second surface of the second section and positioned to each independently couple with the one or more latches.

In one embodiment, the foldable rescue stretcher further includes one or more support holes each independently located on the second surface of the first section, the second surface of the second section, and the second surface of the third section.

In one embodiment, the foldable rescue stretcher further includes a pillow coupled to the second surface of the first section at the proximal end.

In one embodiment, the foldable rescue stretcher further includes a first cushion coupled to the second surface of the first section.

In one embodiment, the foldable rescue stretcher further includes a second cushion coupled to the second surface of the second section.

In one embodiment, the foldable rescue stretcher further includes a third cushion coupled to the second surface of the third section.

In one embodiment, the rigid supporting frame includes a metal, a plastic, a wood, or a combination thereof. In one embodiment, the rigid supporting frame includes aluminum.

In one embodiment, the first protective barrier, the second protective barrier, and the third protective barrier each independently comprise a ballistic-resistant protective material. In one embodiment, the ballistic-resistant protective material includes a para-aramid synthetic material.

The present invention provides a foldable rescue stretcher having an open position for transporting a patient and a storing position for storing the foldable rescue stretcher. The foldable rescue stretcher includes: a rigid supporting frame having a first surface, a second surface, a third surface, a fourth surface, a proximal end, and a distal end, wherein the rigid supporting frame forms an internal cavity extending from the proximal end to the distal end, the rigid supporting frame including: a first section having a first surface, a second surface, a third surface, a fourth surface, a proximal end, and a distal end, the first section including: a pillow coupled to the second surface of the first section at the proximal end; a first cushion coupled to the second surface of the first section adjacent the pillow; one or more first restraining belts each independently having a proximal end and a distal end coupled to the second surface of the first section; one or more first handles each independently coupled to the proximal end of the first section; a first protective barrier coupled to the first surface, the third surface, and the fourth surface of the first section; a second section having a first surface, a second surface, a third surface, a fourth surface, a proximal end, and a distal end, the second section including: a second cushion coupled to the second surface of the second section; one or more second restraining belts each independently having a proximal end and a distal end coupled to the second surface of the second section, wherein a second protective barrier covers the first surface, the third surface, and the fourth surface of the second section, wherein the proximal end of the second section is coupled to the distal end of the first section with one or more first folding locking mechanical joints on the first surface of the first section and the first surface of the second section; and a third section having a first surface, a second surface, a third surface, a fourth surface, a proximal end, and a distal end, the third section including: a third cushion coupled to the second surface of the third section; one or more third restraining belts each independently having a proximal end and a distal end coupled to the second surface of the third section; one or more second handles each independently coupled to the distal end of the third section, wherein a third protective barrier covers the first surface, the third surface, and the fourth surface of the third section, and wherein the proximal end of the third section is coupled to the distal end of the second section with one or more second folding locking mechanical joints on the second surface of the second section and the second surface of the third section.

The present invention provides a foldable rescue stretcher having an open position for transporting a patient and a storing position for storing the foldable rescue stretcher. The foldable rescue stretcher includes: a rigid supporting frame having a first surface, a second surface, a third surface, a fourth surface, a proximal end, and a distal end, wherein the rigid supporting frame forms an internal cavity extending from the proximal end to the distal end, the rigid supporting frame including: a first section having a first surface, a second surface, a third surface, a fourth surface, a proximal end, and a distal end, the first section including: a pillow coupled to the second surface of the first section at the proximal end; a first cushion coupled to the second surface of the first section adjacent the pillow; one or more first restraining belts each independently having a proximal end and a distal end coupled to the second surface of the first section; one or more first handles each independently coupled to the proximal end of the first section; a first protective barrier coupled to the first surface, the third surface, and the fourth surface of the first section; a second section having a first surface, a second surface, a third surface, a fourth surface, a proximal end, and a distal end, the second section including: a second cushion coupled to the second surface of the second section; one or more second restraining belts each independently having a proximal end and a distal end coupled to the second surface of the second section; wherein a second protective barrier covers the first surface, the third surface, and the fourth surface of the second section, wherein the proximal end of the second section is coupled to the distal end of the first section with one or more first folding locking mechanical joints on the first surface of the first section and the first surface of the second section; and a third section having a first surface, a second surface, a third surface, a fourth surface, a proximal end, and a distal end, the third section including: a third cushion coupled to the second surface of the third section; one or more third restraining belts each independently having a proximal end and a distal end coupled to the second surface of the third section; one or more second handles each independently coupled to the distal end of the third section; wherein a third protective barrier covers the first surface, the third surface, and the fourth surface of the third section; wherein the proximal end of the third section is coupled to the distal end of the second section with one or more second folding locking mechanical joints on the second surface of the second section and the second surface of the third section, wherein the first protective barrier, the second protective barrier, and the third protective barrier each independently comprise a ballistic-resistant protective material, one or more support holes each independently located on the second surface of the first section, the second surface of the second section, and the second surface of the third section; one or more latches each independently coupled to the first surface of the first section and the second surface of the third section; one or more latch fasteners each independently coupled to the first surface of the second section and the second surface of the second section and positioned to each independently couple with the one or more latches; one or more support legs each independently coupled to the first surface of the first section, the first surface of the second section, and the first surface of the third section; and an inflatable collar coupled to the third surface, the fourth surface, and the proximal end of the rigid supporting frame.

BRIEF DESCRIPTION OF THE DRAWINGS

Embodiments of the invention may be best understood by referring to the following description and accompanying drawings, which illustrate such embodiments. In the drawings.

Figure 1:
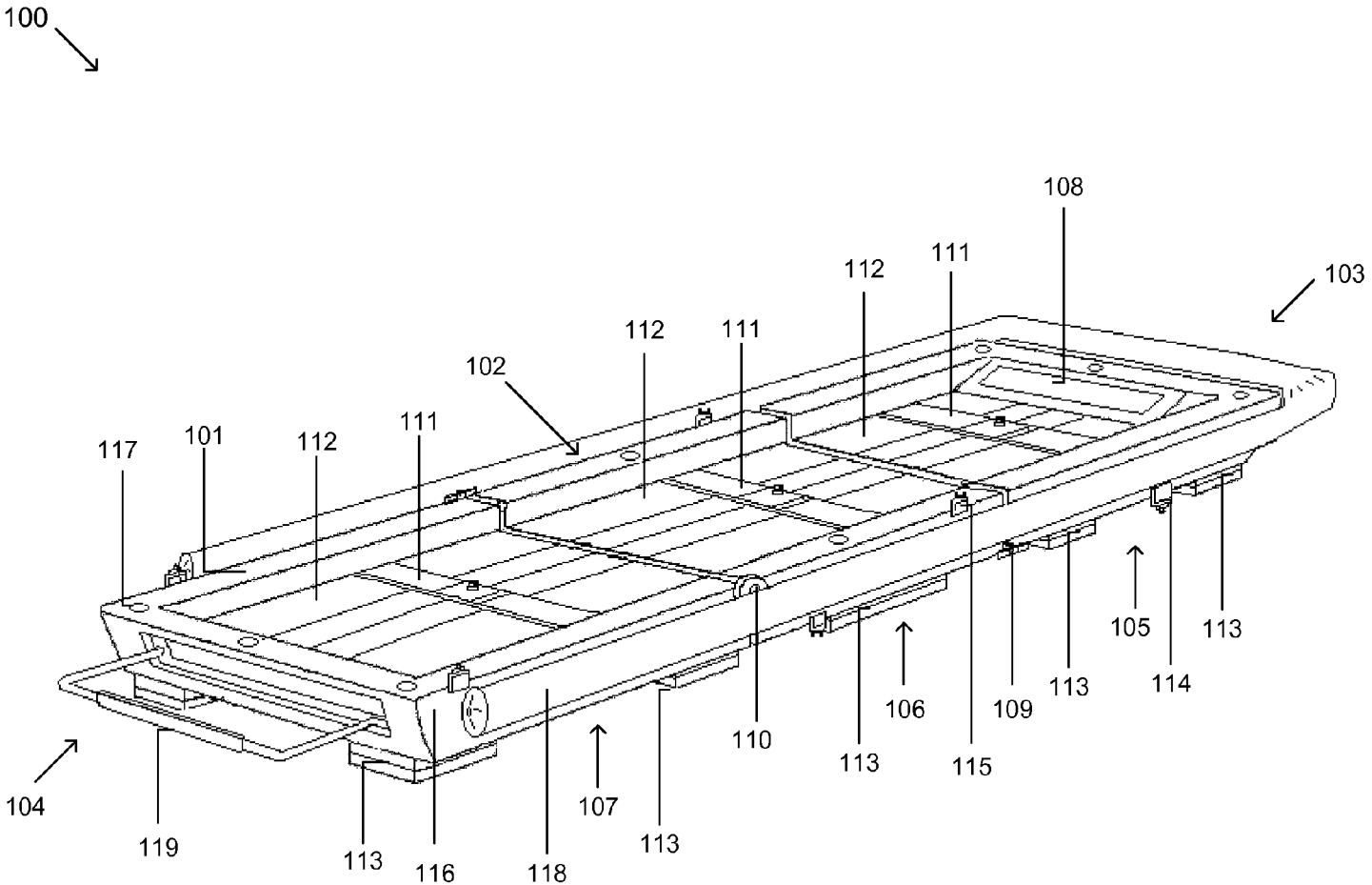
FIG. 1 is a perspective-view drawing illustrating an exemplary folding rescue stretcher in an open position.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a foldable rescue stretcher having an open position for transporting a patient and a storing position for storing the foldable rescue stretcher. The foldable rescue stretcher includes a rigid supporting frame having a plurality of sections, a protective barrier, and an inflatable collar. The foldable rescue stretcher is used to transport a patient in the field with greater ease. The foldable rescue stretcher is lightweight can be transported, folded, and unfolded by one person. The inflatable collar can be easily inflated by mouth, a hand or foot pump, or a pressurized gas cylinder to provide flotation in a marine environment. Once deployed with a patient therein, the foldable rescue stretcher can be hoisted from land or sea by a helicopter or other rescue transport.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the phrase "ballistic resistant materials" refer to materials, coatings, composites or combinations thereof that are capable of slowing, stopping, fragmenting or deflecting projectiles in motion. This includes, but is not limited to, ballistic grade steel, reactive armor, titanium, composites, spring steels, organic-based fibers and fabrics, ceramics, and coatings. (Further and more detailed information on ballistic resistant materials and their normal applications can be acquired from numerous military and industry sources such as, e.g., *The AMPTIAC Quarterly*, Vol. 8, Number 4 (2004), published by the Advanced Materials and Processes Technology Information Analysis Center (AMPTTAC)).

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the phrase "operatively coupled" refers to bringing two or more items together or into relationship with each other such that they may operate together or allow transfer of information between the two or more items.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

FIG. 1 is a perspective-view drawing illustrating an exemplary folding rescue stretcher 100 with a protective barrier and an inflatable collar. The folding rescue stretcher 100 is in an open position for transporting a patient (not shown). The folding rescue stretcher 100 includes a rigid supporting frame 101 that forms an internal cavity 102 extending from the proximal end 103 to the distal end 104. The rigid supporting frame 101 includes a first section 105, a second section 106, and a third section 107. The first section 105 includes a pillow 108, and a handle (not shown). The first section 105 is coupled to the second section 106 by a first mechanical folding joint 109. The second section 106 is coupled to the third section 107 by a second mechanical folding joint 110. The first section 105, the second section 106, and the third section 107 each also include safety belts 111, cushions 112, foot pads 113, latches 114, latch fasteners 115, a protective barrier 116, and support holes 117. The support holes 117 allow the folding rescue stretcher 100 to be coupled to a hoist system (not shown). An inflatable collar 118 is attached to the exterior of the folding rescue stretcher 100. The third section 107 includes a handle 119. The protective barrier 116 may include a ballistic-resistant protective material. In one embodiment, the ballistic-resistant protective material includes a para-aramid synthetic material (e.g., Kevlar, Twaron, and the like), Lexan, bullet-proof glass, bullet-proof fiberglass, bullet-proof Plexiglass, carbon fiber composite materials, steel, titanium, and the like.

Figure 2:
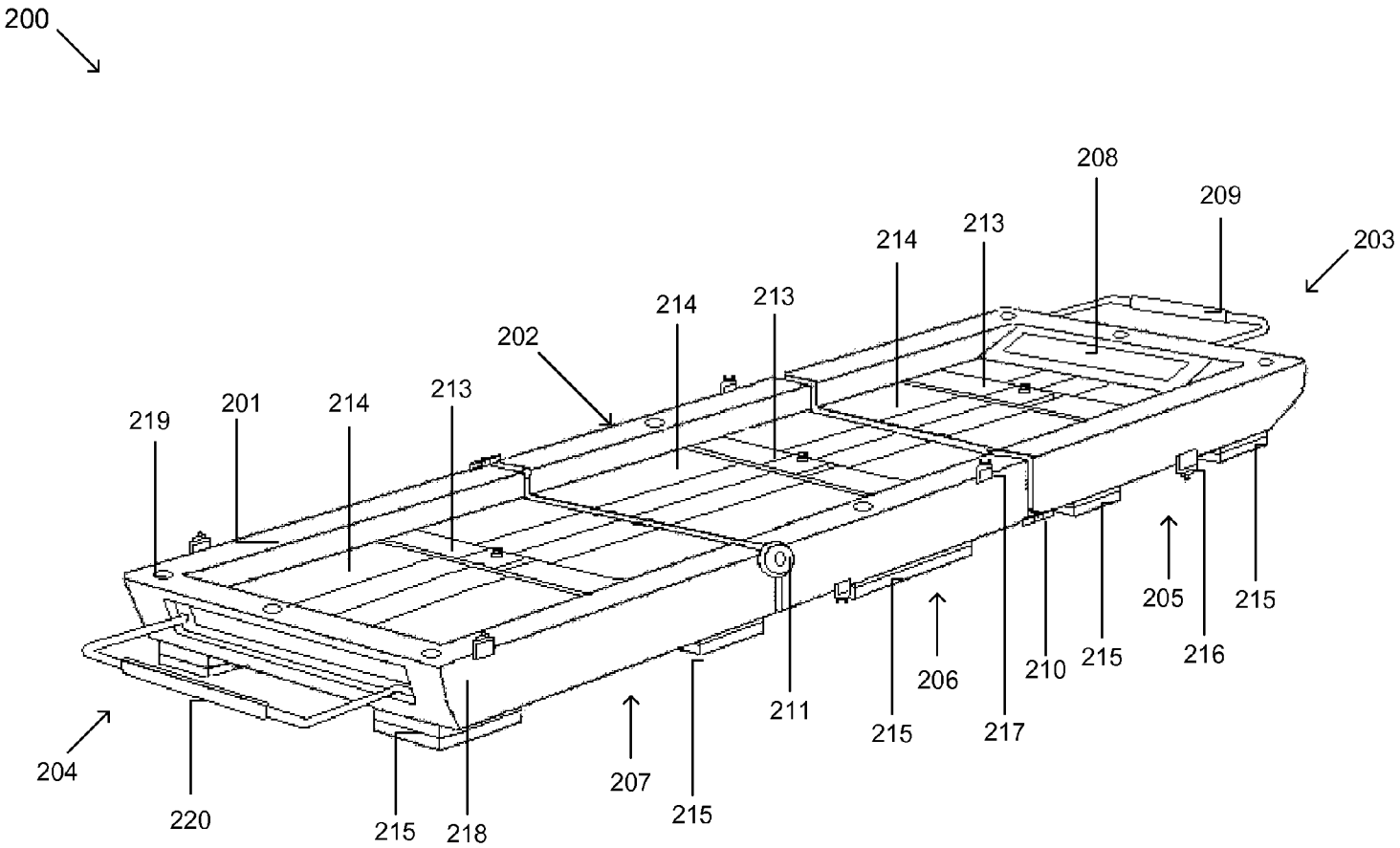
FIG. 2 is a perspective-view drawing illustrating an exemplary folding rescue stretcher in an open position.

FIG. 2 is a perspective-view drawing illustrating an exemplary folding rescue stretcher 200 with a synthetic fiber protective barrier and without an inflatable collar. The folding rescue stretcher 200 is in an open position for transporting a patient (not shown). The folding rescue stretcher 200 includes a rigid supporting frame 201 that forms an internal cavity 202 extending from the proximal end 203 to the distal end 204. The rigid supporting frame 201 includes a first section 205, a second section 206, and a third section 207. The first section 205 includes a pillow 208, and a handle 209. The first section 205 is coupled to the second section 206 by a first mechanical folding joint 210. The second section 206 is coupled to the third section 207 by a second mechanical folding joint 211. The first section 205, the second section 206, and the third section 207 each also include safety belts 213, cushions 214, foot pads 215, latches 216, latch fasteners 217, a protective barrier 218, and support holes 219. The support holes 219 allow the folding rescue stretcher 200 to be coupled to a hoist system (not shown). The third section 207 includes a handle 220.

Figure 3:
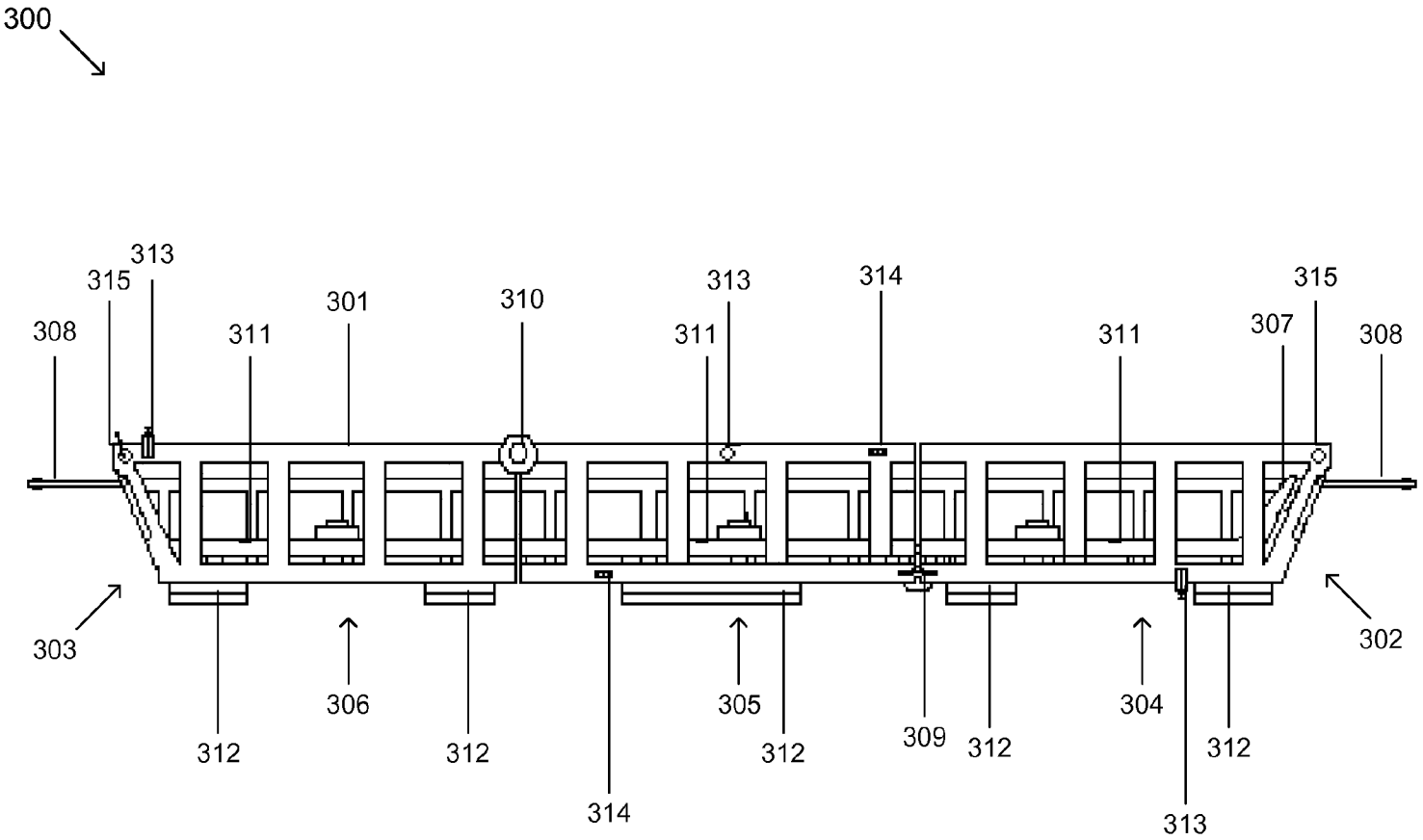
FIG. 3 is a side-view drawing illustrating an exemplary folding rescue stretcher in an open position without a protective barrier.

FIG. 3 is a side-view drawing illustrating an exemplary folding rescue stretcher 300 without a protective barrier. The folding rescue stretcher 300 is in an open position for transporting a patient (not shown). The folding rescue stretcher 300 includes a rigid supporting frame 301 that forms an internal cavity (not shown) extending from the proximal end 302 to the distal end 303. The rigid supporting frame 301 includes a first section 304, a second section 305, and a third section 306. The first section 304 includes a pillow 307, and a handle 308. The first section 304 is coupled to the second section 305 by a first mechanical folding joint 309. The second section 305 is coupled to the third section 306 by a second mechanical folding joint 310. The first section 304, the second section 305, and the third section 305 each also include cushions 311, foot pads 312, latches 313, latch fasteners 314, and support holes 315. The support holes 315 allow the folding rescue stretcher 300 to be coupled to a hoist system (not shown). An inflatable collar (not shown) is attached to the exterior of the folding rescue stretcher 300.

Figure 4:
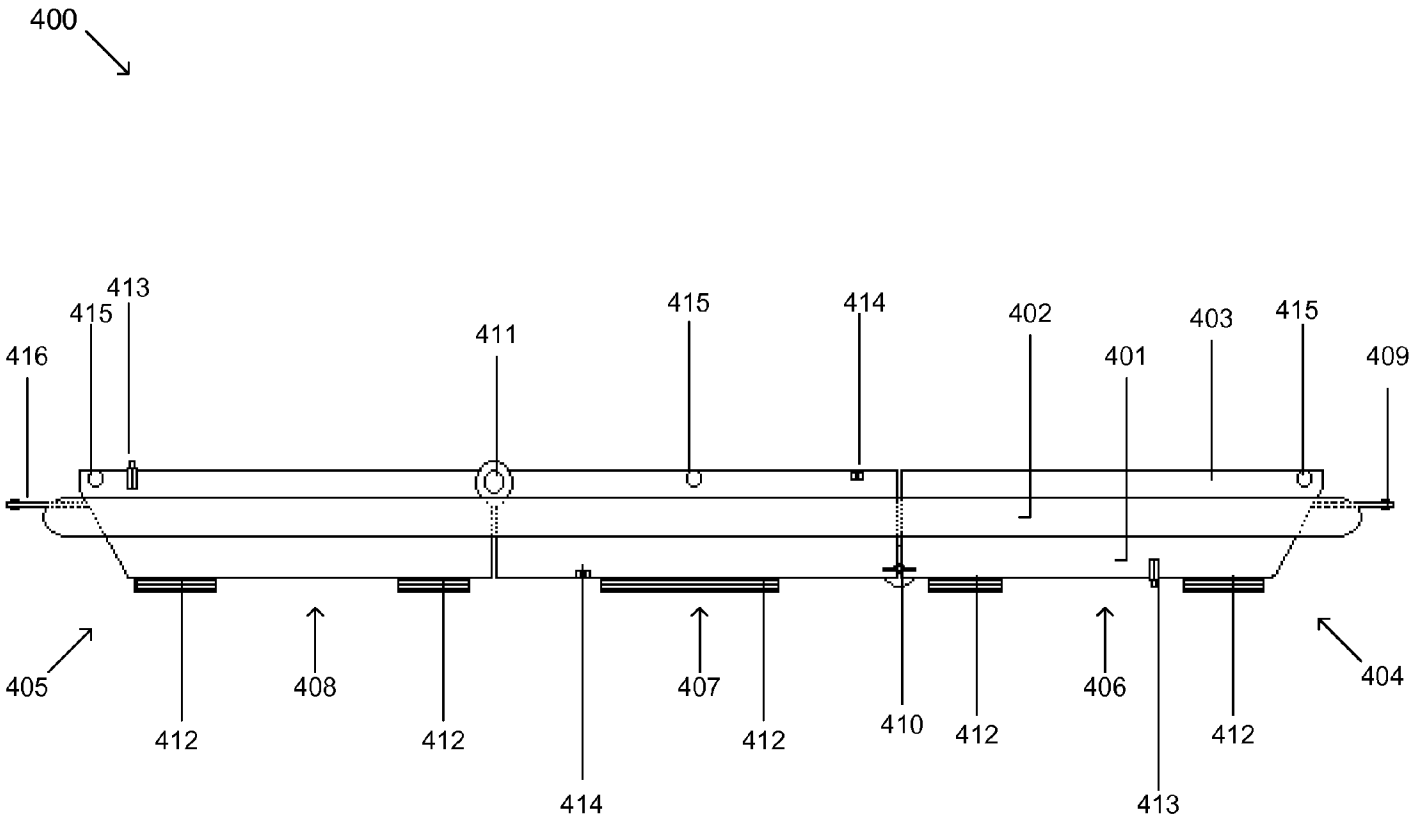
FIG. 4 is a side-view drawing illustrating an exemplary folding rescue stretcher in an open position.

FIG. 4 is a side-view drawing illustrating an exemplary folding rescue stretcher 400 with a protective barrier 401 and an inflatable collar 402. The folding rescue stretcher 400 is in an open position for transporting a patient (not shown). The folding rescue stretcher 400 includes a rigid supporting frame 403 that forms an internal cavity (not shown) extending from the proximal end 404 to the distal end 405. The rigid supporting frame 403 includes a first section 406, a second section 407, and a third section 408. The first section 406 includes a handle 409. The first section 406 is coupled to the second section 407 by a first mechanical folding joint 410. The second section 407 is coupled to the third section 408 by a second mechanical folding joint 411. The first section 406, the second section 407, and the third section 408 each also include cushions (not shown), foot pads 412, latches 413, latch fasteners 414, and support holes 415. The third section 408 includes a handle 416. The support holes 415 allow the folding rescue stretcher 400 to be coupled to a hoist system (not shown). The inflatable collar 402 is attached to the exterior of the folding rescue stretcher 400.

Figure 5:
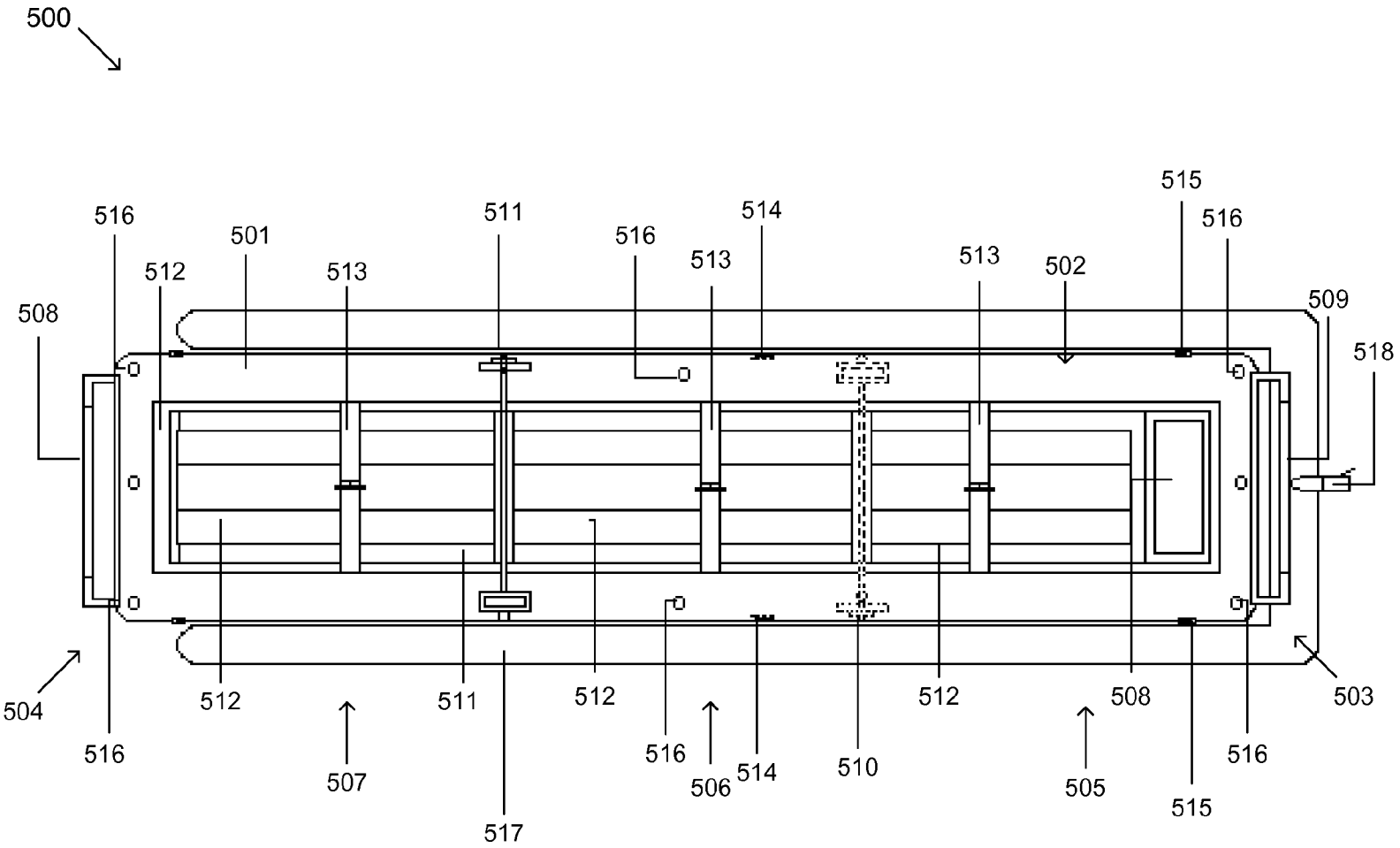
FIG. 5 is a top-view drawing illustrating an exemplary folding rescue stretcher in an open position.

FIG. 5 is a top-view drawing illustrating an exemplary folding rescue stretcher 500. The folding rescue stretcher 500 is in an open position for transporting a patient (not shown). The folding rescue stretcher 500 includes a rigid supporting frame 501 that forms an internal cavity 502 extending from the proximal end 503 to the distal end 504. The rigid supporting frame 501 includes a first section 505, a second section 506, and a third section 507. The first section 505 includes a pillow 508 and a handle 509. The first section 505 is coupled to the second section 506 by a first mechanical folding joint 510. The second section 506 is coupled to the third section 506 by a second mechanical folding joint 511. The first section 505, the second section 506, and the third section 507 each also include cushions 512, safety belts 513, foot pads (not shown), latches 514, latch fasteners 515, and support holes 516. The support holes 516 allow the folding rescue stretcher 500 to be coupled to a hoist system (not shown). An inflatable collar 517 is attached to the exterior of the folding rescue stretcher 500. The inflatable collar 517 includes a gas inlet 518, which connects to a gas cylinder (not shown) to allow for inflation of the inflatable collar 517.

Figure 6:
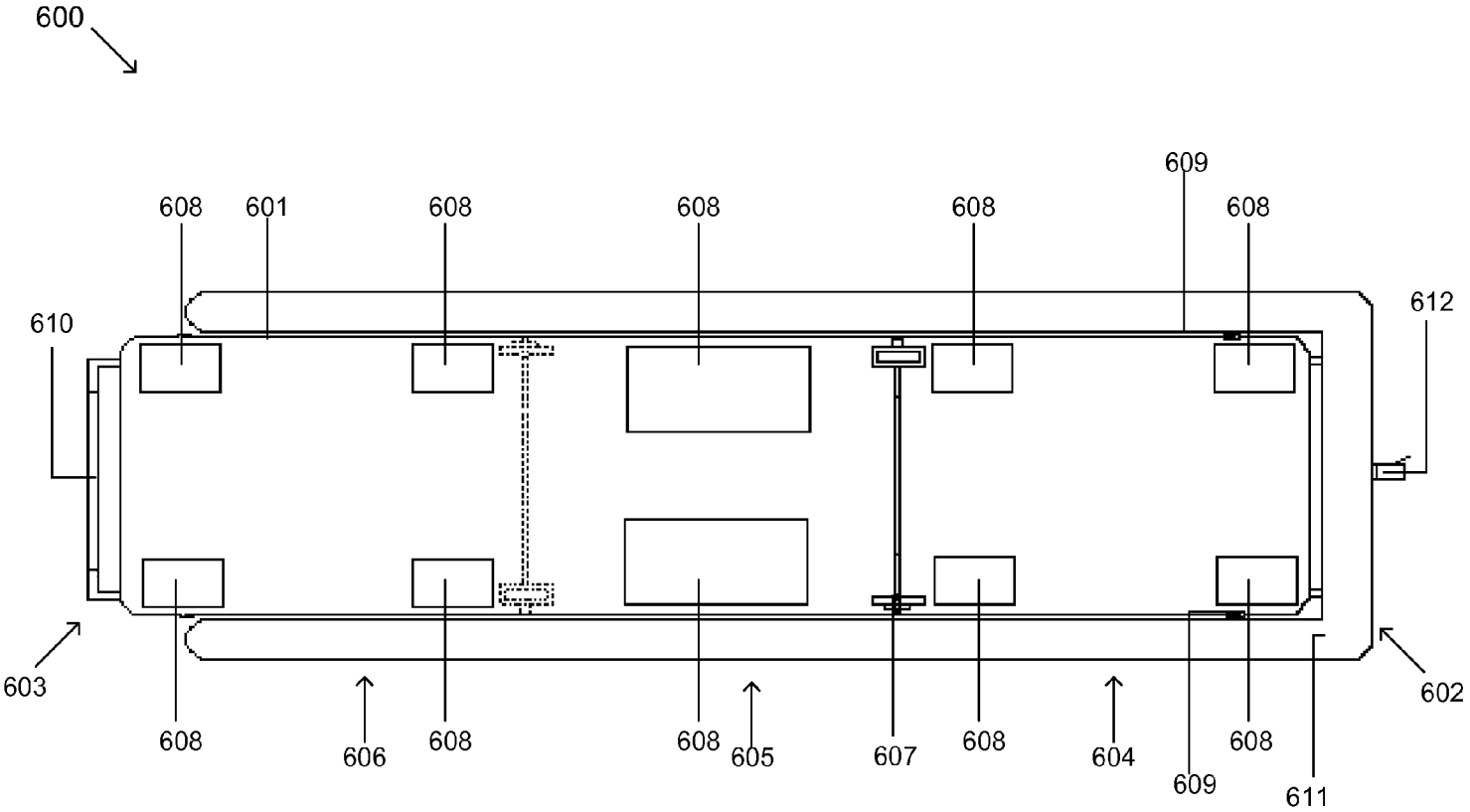
FIG. 6 is a bottom-view drawing illustrating an exemplary folding rescue stretcher in an open position.

FIG. 6 is a bottom-view drawing illustrating an exemplary folding rescue stretcher 600. The folding rescue stretcher 600 is in an open position for transporting a patient (not shown). The folding rescue stretcher 600 includes a rigid supporting frame 601 that forms an internal cavity (not shown) extending from the proximal end 602 to the distal end 603. The rigid supporting frame 601 includes a first section 604, a second section 605, and a third section 606. The first section 605 includes a pillow (not shown) and a handle (not shown). The first section 604 is coupled to the second section 605 by a first mechanical folding joint 607. The second section 605 is coupled to the third section 606 by a second mechanical folding joint (not shown). The first section 605, the second section 606, and the third section 607 each also include cushions (not shown), safety belts (not shown), foot pads 608, latches (not shown), latch fasteners 609, and support holes (not shown. The third section includes a handle 610. An inflatable collar 611 is attached to the exterior of the folding rescue stretcher 600. The inflatable collar 611 includes a gas inlet 612, which connects to a gas cylinder (not shown) to allow for inflation of the inflatable collar 610.

Figure 7:
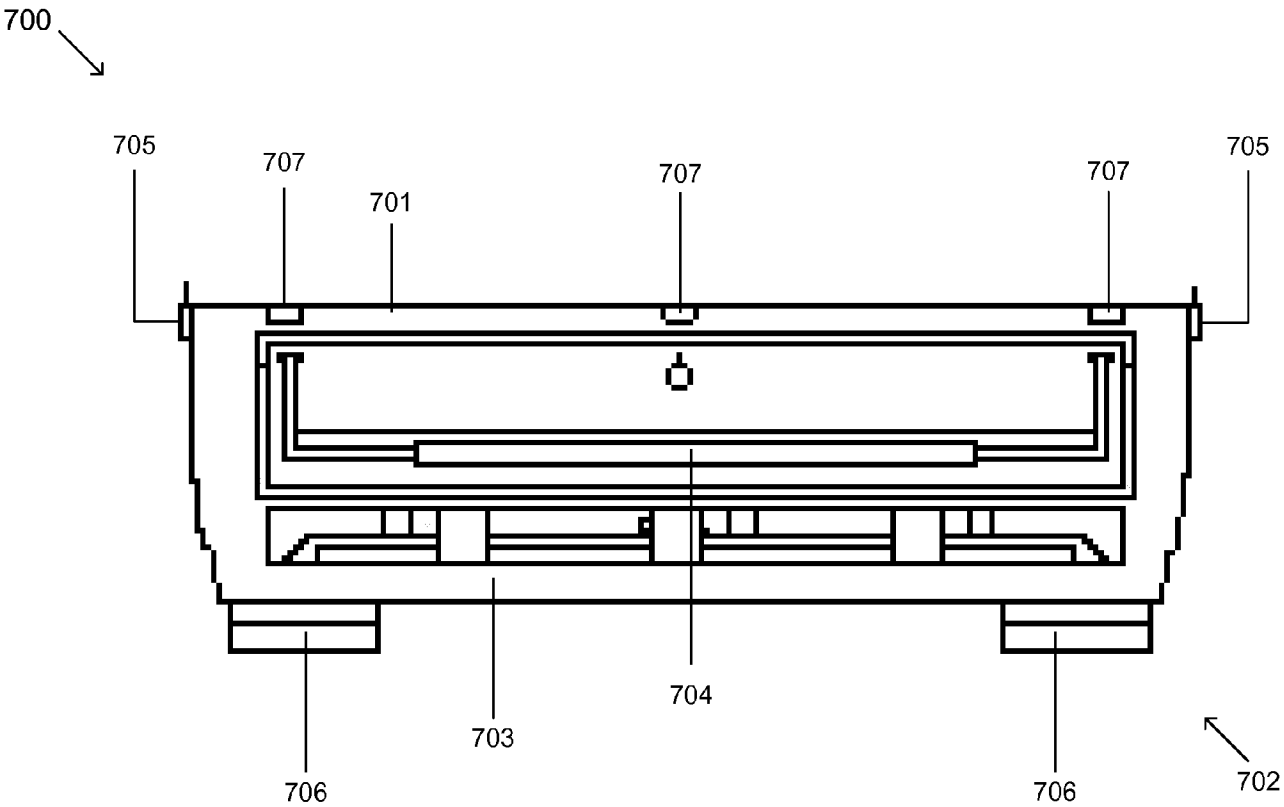
FIG. 7 is a side-view drawing illustrating an exemplary folding rescue stretcher in an open position.

FIG. 7 is a side-view drawing illustrating an exemplary folding rescue stretcher 700 without the inflatable collar and a protective barrier. The folding rescue stretcher 700 is in an open position for transporting a patient (not shown). The folding rescue stretcher 700 includes a rigid supporting frame 701 that forms an internal cavity (not shown) extending from the proximal end 702 to the distal end (not shown). The rigid supporting frame 701 includes a first section 703, a second section (not shown), and a third section (not shown). The first section 703 includes a handle 704, latches 705, foot pads 706, and support holes 707.

Figure 8:
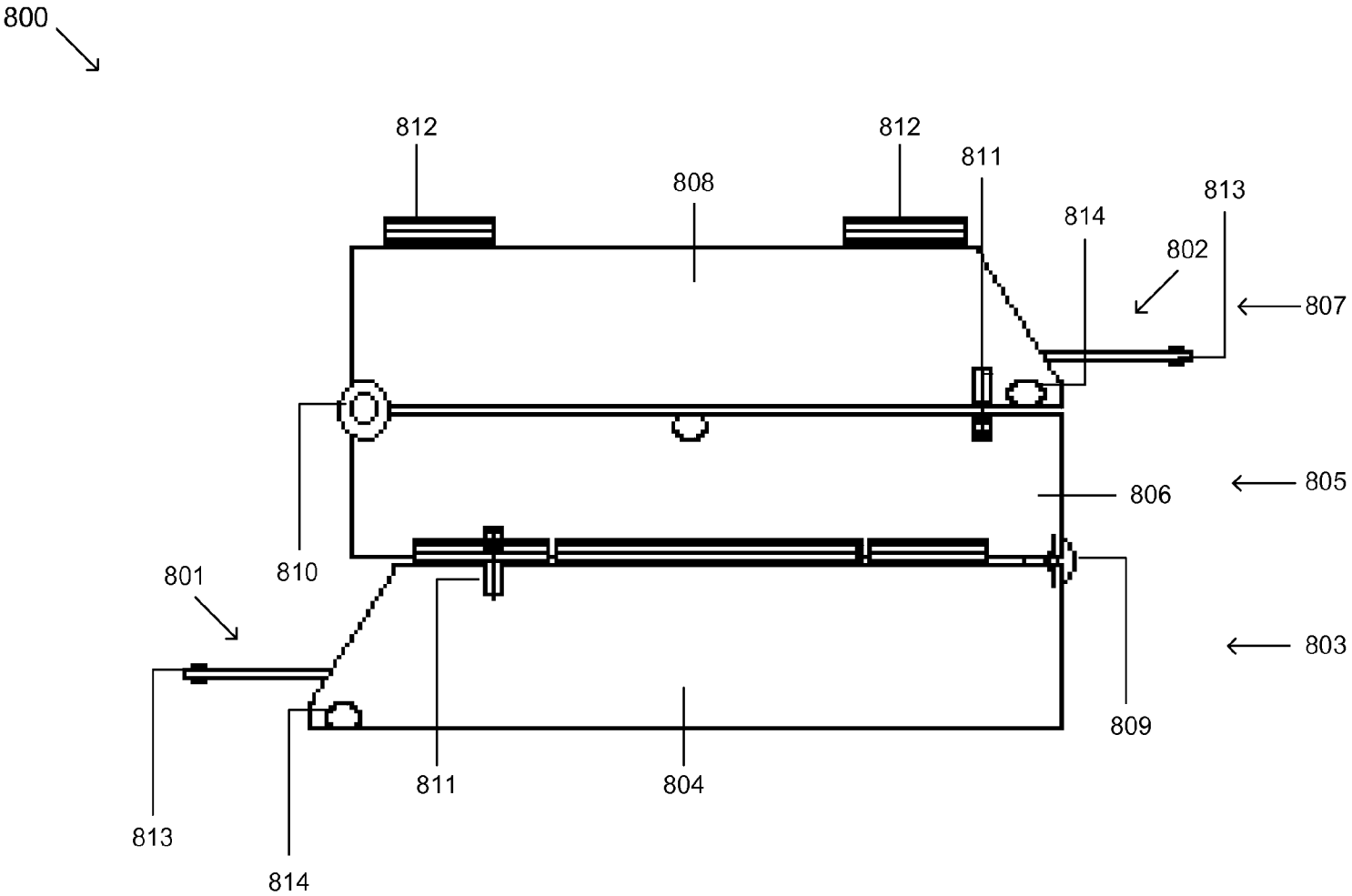
FIG. 8 is a side-view drawing illustrating an exemplary folding rescue stretcher in a folded position.

FIG. 8 is a side-view drawing illustrating an exemplary folding rescue stretcher 800 in a folded position and without the inflatable collar. The folding rescue stretcher 800 includes a proximal end 801, a distal end 802, rigid supporting frame (not shown), a first section 803 with a protective barrier 804, a second section 805 with a protective barrier 806, a third section 807 with a protective barrier 808, a first mechanical folding joint 809, a second mechanical folding joint 810, latches 811, foot pads 812, handles 813, and support holes 814.

Figure 9:
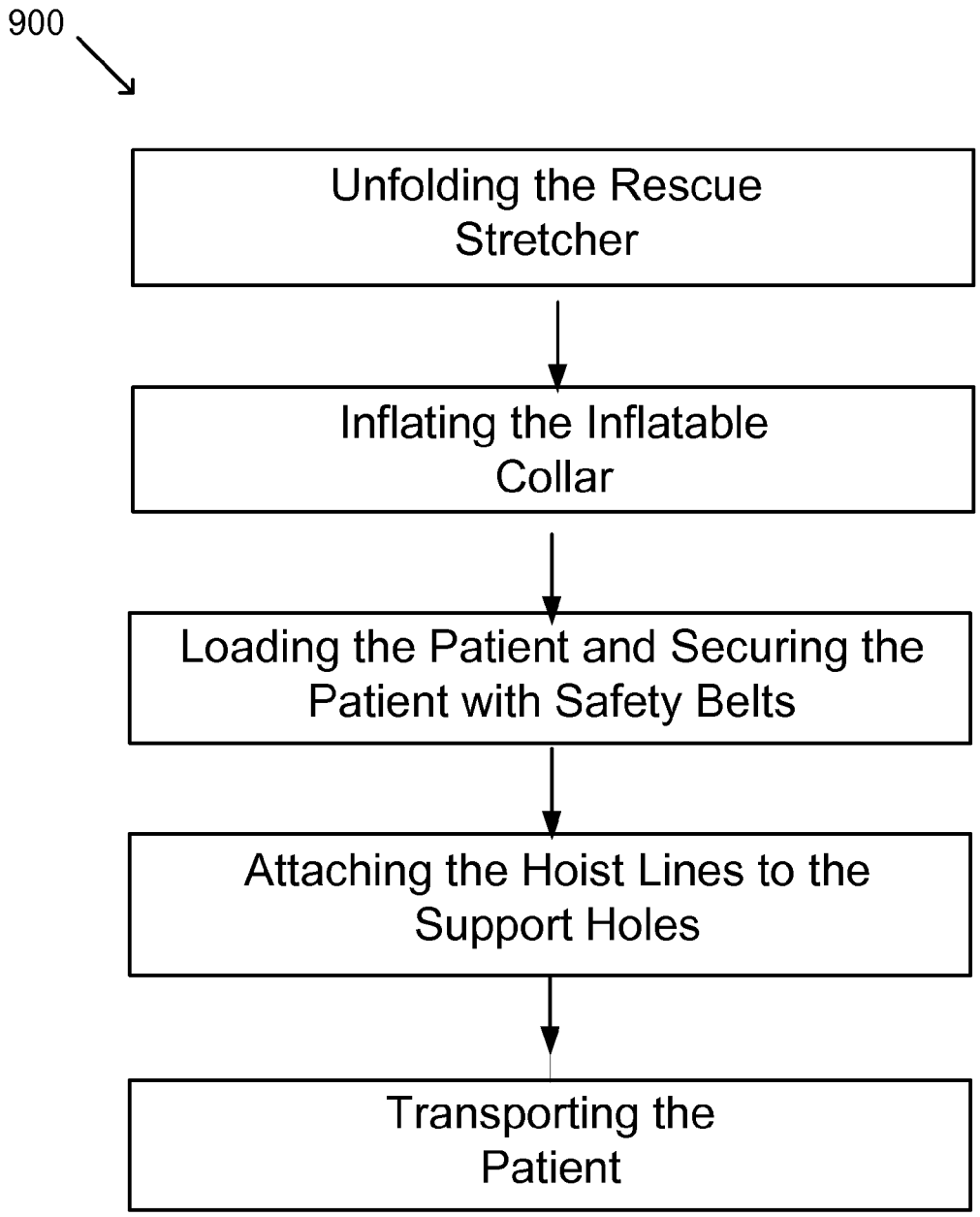
FIG. 9 is a block diagram illustrating an exemplary method of using an exemplary folding rescue stretcher.

FIG. 9 is a block diagram illustrating an exemplary method of using an exemplary folding rescue stretcher. The method 900 includes (1) unfolding the folding rescue stretcher, (2) inflating the inflatable collar, (3) loading the patient into the folding rescue stretcher and securing the patient with the safety belts, (4) attaching the hoist lines to the support holes, and (5) transporting the patient.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A foldable rescue stretcher with raised sides having an open position for transporting a patient and a storing position for storing the foldable rescue stretcher with raised sides, the foldable rescue stretcher with raised sides comprising:

a rigid supporting frame with raised sides having a first surface, a second surface, a first raised side, a second raised side, a proximal end raised side, and a distal end raised side, wherein the rigid supporting frame with raised sides forms an internal cavity on the second surface and extending from an interior side of proximal end raised side between an interior surface of the first raised side and an interior surface of second raised side to an interior side of distal end raised side, the rigid supporting frame with raised sides comprising:

a first section having a first surface, a second surface, a first raised side, a second raised side, a proximal end raised side, and a distal end side, the first section comprising:

one or more first restraining belts each independently having a proximal end and a distal end coupled to the first raised side and the second raised side of the first section;

one or more first handles each independently coupled to an exterior side of the proximal end raised side of the first section;

a first protective barrier directly coupled to an entire length of an entire exterior side of the first raised side, an entire length of an entire exterior side of the second raised side, an entire length of an entire exterior side of the proximal end raised side, and to the first surface of the first section;

a second section having a first surface, a second surface, a first raised side, a second raised side, a proximal end side, and a distal end side, the second section comprising:

one or more second restraining belts each independently having a proximal end and a distal end and each independently coupled to the first raised side and the second raised side of the second section;

wherein a second protective barrier is directly coupled to an entire exterior side of, the first raised side, an entire exterior side of the second raised side, and to the first surface of the second section, wherein the proximal end side of the second section is coupled to the distal end side of the first section with one or more first folding locking mechanical joints on the first surface of the first section and the first surface of the second section;

a third section having a first surface, a second surface, a first raised side, a second raised side, a proximal end side, and a distal end raised side, the third section comprising:

one or more third restraining belts each independently having a proximal end and a distal end and each independently coupled to the first raised side and the second raised side of the third section;

one or more second handles each independently coupled to an exterior side of the distal end raised side of the third section;

wherein a third protective barrier is directly coupled to an entire exterior side of the first raised side, of an entire exterior side of the second raised side, and to the first surface of the third section;

wherein the proximal end of the third section is directly coupled to the distal end of the second section with one or more second folding locking mechanical joints on the second surface of the second section and the second surface of the third section;

one or more latches each independently coupled to the first surface of the first section and the second surface of the third section;

one or more latch fasteners each independently coupled to the first surface of the second section and the second surface of the second section and positioned to each independently couple with the one or more latches; and an inflatable collar coupled to an exterior surface of the first raised side, an exterior surface of the second raised side, and to an exterior surface of the proximal raised end of the rigid supporting frame with raised sides.

2. The foldable rescue stretcher with raised sides of claim 1, further comprising one or more support legs each independently coupled to the first surface of the first section, the first surface of the second section, and the first surface of the third section.

3. The foldable rescue stretcher with raised sides of claim 1, further comprising one or more support holes each independently located on the second surface of the first section, the second surface of the second section, and the second surface of the third section.

4. The foldable rescue stretcher with raised sides of claim 1, further comprising a pillow coupled to the second surface of the first section at the proximal raised end.

5. The foldable rescue stretcher with raised sides of claim 1, further comprising a first cushion coupled to the second surface of the first section.

6. The foldable rescue stretcher with raised sides of claim 1, further comprising a second cushion coupled to the second surface of the second section.

7. The foldable rescue stretcher with raised sides of claim 1, further comprising a third cushion coupled to the second surface of the third section.

8. The foldable rescue stretcher with raised sides of claim 1, wherein the rigid supporting frame with raised sides comprises a metal, a plastic, a wood, or a combination thereof.

9. The foldable rescue stretcher with raised sides of claim 8, wherein the rigid supporting frame with raised sides comprises aluminum.

10. The foldable rescue stretcher with raised sides of claim 1, wherein the first protective barrier, the second protective barrier, and the third protective barrier each independently comprise a ballistic-resistant protective material.

11. The foldable rescue stretcher with raised sides of claim 10, wherein the ballistic-resistant protective material comprises a para-aramid synthetic material.

12. A foldable rescue stretcher with raised sides having an open position for transporting a patient and a storing position for storing the foldable rescue stretcher with raised sides, the foldable rescue stretcher with raised sides comprising:

a rigid supporting frame with raised sides having a first surface, a second surface, a first raised side, a second raised side, a proximal end raised side, and a distal end raised side, wherein the rigid supporting frame forms an internal cavity on the second surface and extending from an interior side of proximal end raised side between an interior surface of the first raised side and an interior surface of second raised side to an interior side of distal end raised side, the rigid supporting frame with raised sides comprising:

a first section having a first surface, a second surface, a first raised side, a second raised side, a proximal end raised side, and a distal end side, the first section comprising:

a pillow coupled to the second surface of the first section at the proximal end;

a first cushion coupled to the second surface of the first section adjacent the pillow;

one or more first restraining belts each independently having a proximal end and a distal end coupled to the first raised side and the second raised side of the first section;

one or more first handles each independently coupled to an exterior side of the proximal end raised side of the first section;

a first protective barrier directly coupled to an entire exterior side of the first raised side, an entire exterior side of the second raised side, an entire exterior side of the proximal end raised side, and to the first surface of the first section;

a second section having a first surface, a second surface, a first raised side, a second raised side, a proximal end side, and a distal end side, the second section comprising:

a second cushion coupled to the second surface of the second section;

one or more second restraining belts each independently having a proximal end and a distal end and each independently coupled to the first raised side and the second raised side of the second section;

wherein a second protective barrier is directly coupled to an entire exterior side of, the first raised side, an entire exterior side of the second raised side, and to the first surface of the second section, wherein the proximal end side of the second section is coupled to the distal end side of the first section with one or more first folding locking mechanical joints on the first surface of the first section and the first surface of the second section;

a third section having a first surface, a second surface, a first raised side, a second raised side, a proximal end side, and a distal end raised side, the third section comprising:

a third cushion coupled to the second surface of the third section;

one or more third restraining belts each independently having a proximal end and a distal end and each independently coupled to the first raised side and the second raised side of the third section;

one or more second handles each independently coupled to an exterior side of the distal end raised side of the third section;

wherein a third protective barrier is directly coupled to an entire exterior side of the first raised side, of an entire exterior side of the second raised side, and to the first surface of the third section;

wherein the proximal end of the third section is directly coupled to the distal end of the second section with one or more second folding locking mechanical joints on the second surface of the second section and the second surface of the third section;

one or more latches each independently coupled to the first surface of the first section and the second surface of the third section;

one or more latch fasteners each independently coupled to the first surface of the second section and the second surface of the second section and positioned to each independently couple with the one or more latches; and an inflatable collar coupled to an exterior surface of the first raised side, an exterior surface of the second raised side, and to an exterior surface of the proximal end raised side of the rigid supporting frame with raised sides.

13. A foldable rescue stretcher with raised sides having an open position for transporting a patient and a storing position for storing the foldable rescue stretcher with raised sides, the foldable rescue stretcher with raised sides comprising:

a rigid supporting frame with raised sides having a first surface, a second surface, a first raised side, a second raised side, a proximal end raised side, and a distal end raised side, wherein the rigid supporting frame with raised sides forms an internal cavity on the second surface and extending from an interior side of proximal end raised side between an interior surface of the first raised side and an interior surface of second raised side to an interior side of distal end raised side, the rigid supporting frame with raised sides comprising:

a first section having a first surface, a second surface, a first raised side, a second raised side, a proximal end raised side, and a distal end side, the first section comprising:

a pillow coupled to the second surface of the first section at the proximal end;

a first cushion coupled to the second surface of the first section adjacent the pillow;

one or more first restraining belts each independently having a proximal end and a distal end coupled to the first raised side and the second raised side of the first section;

one or more first handles each independently coupled to an exterior side of the proximal end raised side of the first section;

a first protective barrier directly coupled to an entire exterior side of the first raised side, an entire exterior side of the second raised side, an entire exterior side of the proximal end raised side, and to the first surface of the first section;

a second section having a first surface, a second surface, a first raised side, a second raised side, a proximal end side, and a distal end side, the second section comprising:

a second cushion coupled to the second surface of the second section;

one or more second restraining belts each independently having a proximal end and a distal end and each independently coupled to the first raised side and the second raised side of the second section;

wherein a second protective barrier is directly coupled to an entire exterior side of, the first raised side, an entire exterior side of the second raised side, and to the first surface of the second section, wherein the proximal end side of the second section is coupled to the distal end side of the first section with one or more first folding locking mechanical joints on the first surface of the first section and the first surface of the second section;

a third section having a first surface, a second surface, a first raised side, a second raised side, a proximal end side, and a distal end raised side, the third section comprising:

a third cushion coupled to the second surface of the third section;

one or more third restraining belts each independently having a proximal end and a distal end and each independently coupled to the first raised side and the second raised side of the third section;

one or more second handles each independently coupled to an exterior side of the distal end raised side of the third section;

wherein a third protective barrier is directly coupled to an entire exterior side of the first raised side, of an entire exterior side of the second raised side, and to the first surface of the third section;

wherein the proximal end of the third section is directly coupled to the distal end of the second section with one or more second folding locking mechanical joints on the second surface of the second section and the second surface of the third section;

wherein the first protective barrier, the second protective barrier, and the third protective barrier each independently comprise a ballistic-resistant protective material, one or more support holes each independently located on the second surface of the first section, the second surface of the second section, and the second surface of the third section;

one or more latches each independently coupled to the first surface of the first section and the second surface of the third section;

one or more latch fasteners each independently coupled to the first surface of the second section and the second surface of the second section and positioned to each independently couple with the one or more latches;

one or more support legs each independently coupled to the first surface of the first section, the first surface of the second section, and the first surface of the third section; and an inflatable collar coupled to an exterior surface of the first raised side, an exterior surface of the second raised side, and to an exterior surface of the proximal end raised side of the rigid supporting frame with raised sides.

* * * * *